United States Patent [19]

Lootvoet et al.

[11] 3,990,382

[45] Nov. 9, 1976

[54] FASTENING ARRANGEMENT FOR SEALING BARRIER IN INSULATING WALL OF INSULATED COMPARTMENT BUILT INTO A SHIP'S HULL

[75] Inventors: Roger Lootvoet; Pierre Jean, both of Montivilliers, France

[73] Assignee: Gaz Transport, Paris, France

[22] Filed: Mar. 14, 1975

[21] Appl. No.: 558,492

[30] Foreign Application Priority Data

Mar. 21, 1974 France ..... 74.09697

[52] U.S. Cl. ..... 114/74 A; 220/15

[51] Int. Cl.[2] ..... B63B 25/16

[58] Field of Search ..... 114/74 A; 220/9 LG, 220/15

[56] References Cited

UNITED STATES PATENTS

| | | | |
|---|---|---|---|
| 3,331,525 | 7/1967 | Coehn | 114/74 A X |
| 3,485,409 | 12/1969 | Becker | 114/74 A X |
| 3,785,320 | 1/1974 | Bourgeois et al. | 114/74 A |

FOREIGN PATENTS OR APPLICATIONS

| | | | |
|---|---|---|---|
| 2,120,267 | 8/1972 | France | |
| 1,242,467 | 5/1967 | Germany | 114/74 A |

OTHER PUBLICATIONS

"A Corrugated Aluminum Alloy LNG Cargo Tank Design" *Shipbuilding & Engineering Record* Oct. 13, 1972.

*Primary Examiner*—Trygve M. Blix
*Assistant Examiner*—Gregory W. O'Connor
*Attorney, Agent, or Firm*—Brisebois & Kruger

[57] ABSTRACT

Ship having heat insulating compartments built into the framework of the ship has successive first sealing, first insulating, second sealing and second insulating barriers forming the compartment wall. The second sealing barrier is held to the hull of the ship by a fastener passing through the second insulating barrier. This fastener comprises an elongated stud welded to the hull of the ship, a head carried by the stud and a member fixed to the second insulating barrier and fastened to the head. The arrangement is such as to permit relative movement between the second insulating barrier and the hull substantially parallel to the hull.

17 Claims, 16 Drawing Figures

FASTENING ARRANGEMENT FOR SEALING BARRIER IN INSULATING WALL OF INSULATED COMPARTMENT BUILT INTO A SHIP'S HULL

SUMMARY OF THE INVENTION

In order to increase the capacity of ships intended to transport liquefied natural gas and reduce the cost of construction of isothermal tanks, it is advantageous to build these tanks so that they are integrated into the structure of the ship with the walls of the tanks being formed by covering the hull and compartment walls of the ship with fluid-tight and insulating barrier layers.

In French Pat. No. 1,438,330, corresponding to U.S. Pat. Nos. 3,339,800 and 3,403,651, a fluid-tight insulating tank integrated into the supporting structure of a ship is described. This constituted by two successive fluid-tight barrier layers, the first of which is in contact with the liquefied gas being carried and the second of which is positioned between the first barrier layer and the hull of the ship, the two fluid-tight layers being alternated with two heat-insulating layers hereinafter called insulating barriers. In the embodiment described, the secondary insulating barrier consists of boxes filled with an insulating material and attached directly to the double hull or double compartment wall of the ship. These boxes are gas permeable and arranged so that a free space between the boxes permits free circulation of the gas. The secondary barrier consists of strips of thin metal having flanges projecting toward the interior of the ship. The height of these strips is substantially equal to the height of the boxes of heat insulating material, and they are welded together. The strips are connected to the insulating barrier by sliding joints. The first insulating barrier also consists of boxes filled with insulating material and an arrangement similar to that used for the secondary barrier permits free circulation of gas, these boxes being fastened by screws to a series of elongated metallic bars which are parallel to each other and positioned between the parallel rows of boxes. These bars are themselves attached by supporting members which pass in a fluid-tight manner through the secondary fluid-tight barrier to forks positioned from point to point along horizontal wooden planks, which are themselves supported and attached from point to point to brackets welded to the supporting hull. The primary fluid-tight barrier consists, like the secondary barrier, of strips having flanged edges and a height substantially equal to that of the boxes of insulating material. The srips are welded to each other as in the case of the secondary fluid-tight barrier. The strips are attached to the insulating barrier by sliding joints.

In this arrangement, the space between two successive parallel planks in a secondary barrier zone is occupied by an assembly of boxes positioned side by side or one on top of the other, depending on whether the wall is horizontal or vertical and necessarily, since the planks positioned parallel to the major dimension of the boxes have a certain thickness separating two rows of adjacent boxes, the longitudinal median line of a metallic strip is positioned in alignment with each plank so that the flanged edges of this strip lie in the median zone of the rows of the boxes adjacent the strip in order that the welds to the flanged edges between two adjacent strips may be made in alignment with an intermediate strip held in a sliding joint associated with the boxes of the rows adjacent the plank. The strip positioned in alignment with the plank is thus traversed from point to point along its median line by the supports for the parallel metallic bars between which the parallel rows of the boxes of the primary insulating layer are located.

Since all the strips have the same width, it is necessary that the planks, between their median lines, have a distance which is a multiple of the width of the strips and since each plank has a certain thickness, it follows that the boxes of the rows adjacent to each plank necessarily have a smaller width with respect to the other boxes, the width of which is equal to that of the strips. In order to form the secondary insulating barrier it is necessary to use, on the one hand, boxes having a thickness equal to the width of the strips and on the other hand boxes having a reduced width. The necessity for these two types of boxes is disadvantageous from an economic point of view since all the boxes cannot be made at one time in a single series.

Moreover, as has been explained above, the flanged edges of the strips of the secondary sealing barrier are in alignment with the median zone of the boxes of the secondary insulating barrier so that the attachment by the sliding joint of the second intermediate welded strip is provided by a groove on the median line of the boxes of the secondary insulating barrier parallel to the major dimension of said boxes. This groove holds the member of the sliding joint serving to attach the intermediate strip and is formed in the thickness of the corresponding major face of each box. It is obvious that the formation of such a groove is onerous during the manufacture of the boxes of the secondary insulating barrier and that furthermore this groove constitutes a weak zone in the major surface of the box in which it is formed so that it is desirable to provide relatively thick surfaces in order to obtain sufficient strength and this contributes further to an increase in the cost of the boxes of the secondary insulating barrier.

Furthermore, in the embodiment described in French Pat. No. 1,438,330 corresponding to U.S. Pat. Nos. 3,399,800 and 3,403,651, the supporting members which are attached by sliding forks to the planks pass in a fluid-tight manner through the strips which are disposed in alignment with each plank, the seal being provided by welding a flange on each supporting member to the metallic strip traversed by said supporting member. It flows that the metallic strip positioned along one of the walls of the tank is attached from point to point to the plank, which is itself supported by the hull of the ship. Consequently, since the hull of the ship is deformed by the action of the waves and this deformation leads to deformation in the median line of the plank throughout the length of the plank, these deformations result in the application of substantial forces in alignment with the points of attachment of the metallic strips to the supporting members. This leads to a risk of rupture and consequently to difficulty in assuring with certainty the fluid-tightness of the secondary sealing during use.

It is an object of the present invention to improve the construction of the insulating barriers and the secondary fluid-tight or sealing barriers of integrated tanks of the type described in French Pat. No. 1,438,330 corresponding to U.S. Pat. Nos. 3,399,800 and 3,403,651, by eliminating the planks and replacing them by fasteners which connect one part of the supporting members supporting the parallel metallic bars between which the boxes of the primary insulating barrier are located and, on the other hand, the double hull or double partition of the ship. These fasteners are capable of movement to allow for the deformation of the ship in response to the effects of the waves and may be inserted between two adjacent boxes of the secondary insulating barrier without any need to decrease the dimension of these boxes. According to the invention, these fasteners are located from point to point along a line corresponding to the median line of the planks previously used and it is then possible to locate the boxes of the secondary sealing barrier so that the longitudinal median line of a row of boxes is in alignment with the line along which the fasteners replacing the planks are located. It follows that the distance between two succession lines of fasteners, which is equal to a multiple of the width of the strips of the secondary sealing barrier, may also be equal to a multiple of the width of the boxes of the secondary insulating barrier, each of these boxes having a width equal to the width of a strip, the flanged edges of the strips being positioned in the zone in which two parallel rows of boxes lie side by side. It is thus clear that the intermediate strips which permit the flanged edges of two adjacent strips to be welded together may be attached to members which slide on the boxes of the secondary insulating barrier by locating these members in the zones of the edge of the boxes as already indicated in French Pat. No. 1,438,330 corresponding to U.S. Pat. No. 3,399,800 and 3,403,651, in the case of the primary barrier. (See in particular FIG. 6 of this patent.)

It will thus be seen that the use of the arrangement according to the present invention makes it possible to use throughout the secondary insulating barrier boxes which all have the same dimensions, and also makes it possible to eliminate the longitudinal groove which it is necessary to form in one of the major surfaces of the boxes of the second insulating barrier when the technique described in French Pat. No. 1,438,330 corresponding to U.S. Pat. Nos. 3,399,800 and 3,403,651, is used. These two advantages simultaneously permit a decrease in cost of the secondary barrier of the tank. Furthermore, the fasteners provided have a certain mobility with respect to the double partition or double hull of the ship so as to decrease the risk of rupture in the welded zones where the supporting members pass through the secondary sealing barrier.

The present invention is accordingly intended to provide as a new article of manufacture of fluid-tight insulated tank integrated into the supporting structure of a ship, constituted by two successive sealing barriers, the first of which is in contact with the liquefied gas being carried and the second of which is positioned between the first barrier and the double hull or partition of the ship. These two sealing barriers are alternated with two heat insulating barriers, the secondary heat insulating barrier consisting of boxes which are preferably filled with an insulating material and attached directly to the double hull or double partition of the ship. The primary insulating barrier also consists of boxes preferably filled with a heat insulating material, the boxes of the primary insulating barrier being supported by a series of parallel metallic bars positioned between the parallel rows of the boxes, these beams being themselves supported by supporting members passing in a fluid-tight manner through the secondary sealing barrier and bearing on the double hull or double partition of the ship. The boxes of the secondary insulating barrier have substantially the shape of a rectangular parallellopiped. The invention is characterized by the fact that the double hull or double partition of the ship carries from point to point along parallel lines fasteners connected thereto by welding, for example, the ends of these fasteners being capable of displacement substantially parallel to a line along which the attaching means are located. Each fastener comprises a supporting member adapted to support the parallel metallic bars of the primary insulating barrier and is inserted between two adjacent boxes of the secondary insulating barrier in a space provided between each box of a given row parallel to the line along which the attaching devices are located, said line being substantially in alignment with the longitudinal median line of the row of boxes between the boxes of which the fasteners are inserted. The boxes of two parallel rows adjacent the secondary insulating barrier are positioned in alignment with each other and side by side. Four boxes of two parallel adjacent rows are fastened in a known manner to the double hull or double partition of the ship by studs fixed to said double hull or double partition and bearing through a plate on tenons positioned along the edge of the boxes of the secondary insulating barrier, the walls of which border the spaces separating the individual boxes of a given row.

The metallic strips having flanged edges and forming the secondary sealing barrier are located in alignment with each row of boxes so that the flanged edges of the strips are adjacent the edges of the boxes of the same row which are in contact with the edges of the boxes of the immediately adjacent row. The weld between the two flanged edges of the two adjacent metallic strips of the secondary sealing barrier is made by interposing an intermediate strip held by a sliding member which slides on the boxes of the secondary insulating barrier, the sliding member being positioned in a groove formed in the lateral edge of the boxes of the secondary insulating barrier. This lateral edge is parallel to the flanged edges of the strips to be welded. Each strip positioned in alignment with a line of fasteners is traversed in a fluid-tight manner in alignment with one of these fasteners by a supporting member which is connected to the primary insulating barrier.

In a preferred embodiment of the invention the ends of the fasteners which are not connected to the double hull or partition of the ship are adjustable with respect to their distance from the double hull or double partition of the ship, for example, by means of a threaded member. The members which traverse the secondary barrier layer are flanged studs, one of the ends of the stud being threaded, for example onto the free end of a fastener so that its flange may bear on the metallic strip already located in alignment with the fastener. The other end of the stud is threaded and cooperates with a channel member, the two sides of which comprise orifices which receive projections fixed to the metallic bars which run parallel to the primary insulating barrier.

In a first embodiment, the fastener comprises a elongated member, which may be tubular, the base of which is welded to the double hull or double wall of the ship, and the end of which has a threaded portion adapted to receive a head, which head is formed with a peripheral groove which cooperates slidingly with the flanges of a channel member which receives a flanged stud. A heat insulating washer is positioned between the sides of the channel member and the edges of the groove in the head of the attaching device. The head of the fastener is fixed relative to the tubular member by a spot weld or drop of solder after adjustment of the position of the head, or by the application of resin to the thread between the head and the tubular member, which application is preferably made before the head is located in the tubular member. The polymerization of the resin is carried out after a lapse of time sufficiently long to permit the previous adjustment of the position of the head relative to the tubular member. The upper part of the head comprises rotatable adjusting means which may be controlled by a tool passing through the threaded orifice which is to receive the stud and is formed in the channel member.

In a second embodiment, the fastener according to the invention comprises a flexible and metallic plate which is attached by welding, for example, along one of its edges, to the double hull or double wall of the ship and, carries on its opposite edge a threaded stud which cooperates with a threaded head, which head receives at its other end the threads of the stud associated with that fastener. The flanged stud is located in the head after mounting the strip in alignment with the fastener in question, so that the flange of the stud may bear against the strip. The strip is held between said flange and a small plate mounted on the head of the fastener by means of an insulating washer. The small plate is retained on the head by a circular clip. The position of the small plate relative to the head is fixed by a spot weld or drop of solder after it has been put in place. The position of the head with respect to the threaded stud which supports it is determined by the application of polymerizable resin to the thread, which application is preferably made before mounting of the head on the stud, while the polymerization does not place until after adjustment of the position of the head.

In a third embodiment of the invention the fastener according to the invention consists of two parallel flexible elastic plates which are attached, for example, by welding along one of their edges to the double hull or double wall of the ship and attached near their opposite edges to a channel member, fixed to two small plates, said channel member having two strips of wood inserted in the zone between the two small plates, and attached by means of bolts bearing on opposite sides of the strip against gripping plates. The gripping plate which is remote from the double hull or double partition of the ship carries the flanged stud associated with each fastener. The channel member is a U-shaped piece of iron welding on to the two flexible metal plates which pass through slots in the bottom of the U-shaped member.

The advantage of this third embodiment is that it permits an adjustment of the height of a U-shaped member with respect to the flexible and elastic plates fixed to the double hull of the ship and also permits movement of the flanged stud with respect to the U-shaped iron member by sliding the gripping plate which carries the flanged stud on the strip of wood which supports the gripping plate. In order to assure this sliding movement the bolts which traverse the wooden strips, the gripping plates, and the bottom of the U-shaped member are located in seats having a diameter greater than the diameter of the bolts and the bolts are tightened by a torque wrench limiting the tightening force.

In the case of the first embodiment, in order to locate the tubular member of an attaching device between two successive boxes of the same row, it is generally necessary to restrict the median zone of the tenons positioned on the edges of each box which is not intended to come in contact with the adjacent box. This restriction is not necessary when the second and third embodiments of the invention are used because the base of the plate or plates welded to the double hull or double wall of the ship is sufficiently thin to be inserted between the two tenons of two adjacent boxes. On the contrary, since there are always rough edges due to the welding of the edge of the plate to the hull or partition of the ship, it is necessary that the surface of the box which bears against the hull or partition and supports the tenons be set back slightly from the tenons.

It is obvious that the possibility of displacing the head of the fastener in a direction substantially parallel to the line along which the fasteners for the same row of boxes are located results, in the case of the first embodiment, from the translation of the channel member with respect to the head, and in the case of the second embodiment, from the possible flexing of the plate which constitutes the base of the fastener, the thickness of the plate being then selected to obtain the desired resistance to the flexing.

The boxes of the secondary insulating barrier of the sealed and isothermic tank according to the invention may advantageously be put in place by using the improved process described in French Pat. No. 7,402,704, and adapting this process to the tank according to the invention so that no horizontal planks are used. In order to do this at least certain zones of these faces of the boxes of the secondary insulating barrier which bear against the hull or double wall of the ship are lined with a slow drying mastic. The boxes of the secondary insulating barrier which bear on the mastic are first located against the supporting hull. An applicator is located between two reference points, between which the boxes are located. The profile of this applicator, when positioned with respect to the two reference points, constitutes a portion of the surface which it is desired to provide by means of the boxes of the secondary insulating barrier. The points of reference used may be advantageously the ends of the fasteners. The pressure of the said applicator is maintained on each vertical row of boxes during the time necessary to dry the mastic located on the surface of the boxes bearing against the hull or double partition of the ship. The applicators are finally removed so that the metallic strips constituting the second sealing barrier may be located on the boxes of the secondary insulating barrier.

In order that the object of the invention may be better understood, three embodiments thereof will be described, purely by way of illustration and example, with reference to the accompanying drawings on which:

Figure 1:
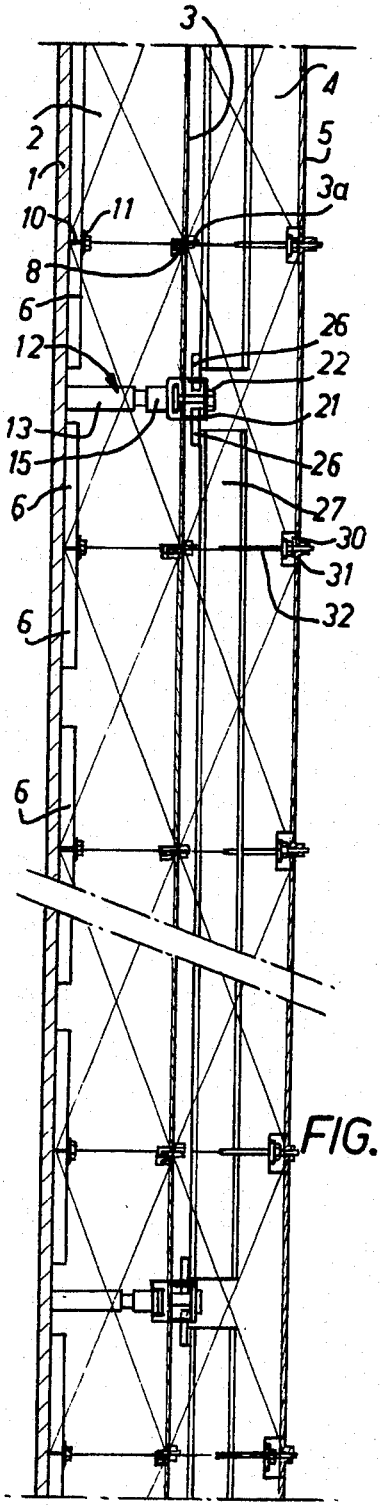
FIG. 1 is a sectional view taken through a wall of the tank according to the invention, said section being taken perpendicular to the double hull of the ship and illustrating the first embodiment of the invention.
Figure 2:
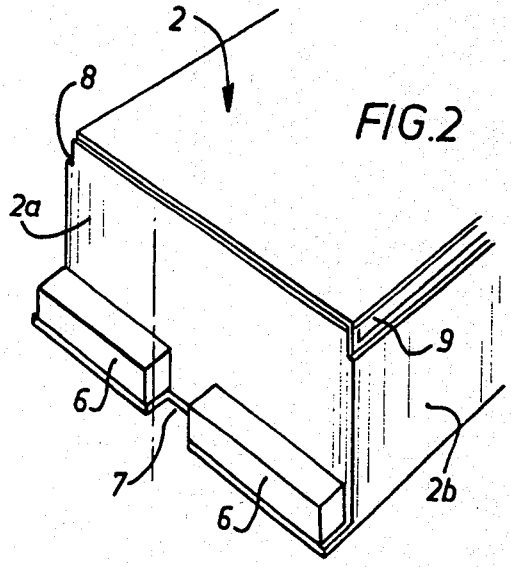
FIG. 2 is a perspective view showing the lateral edge of a box of the secondary insulating barrier of the tank of FIG. 1.
Figure 3:
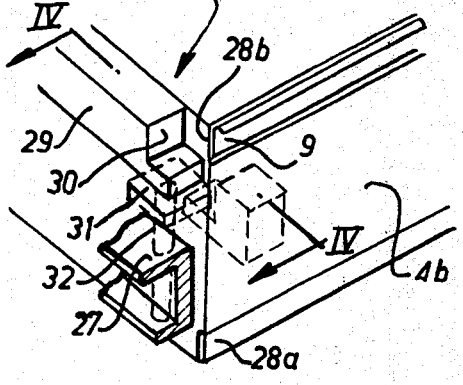
FIG. 3 is a perspective view showing the lateral edge of a primary box of the tank of FIG. 1 with its fastener to the metallic bars which carry the primary insulating barrier.
Figure 4:
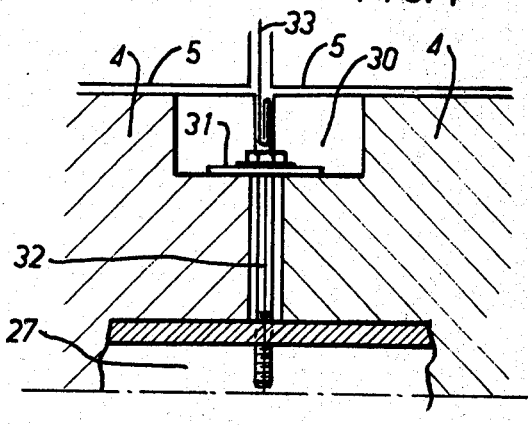
FIG. 4 is a sectional view taken along the line IV—IV of FIG. 3.
Figure 5:
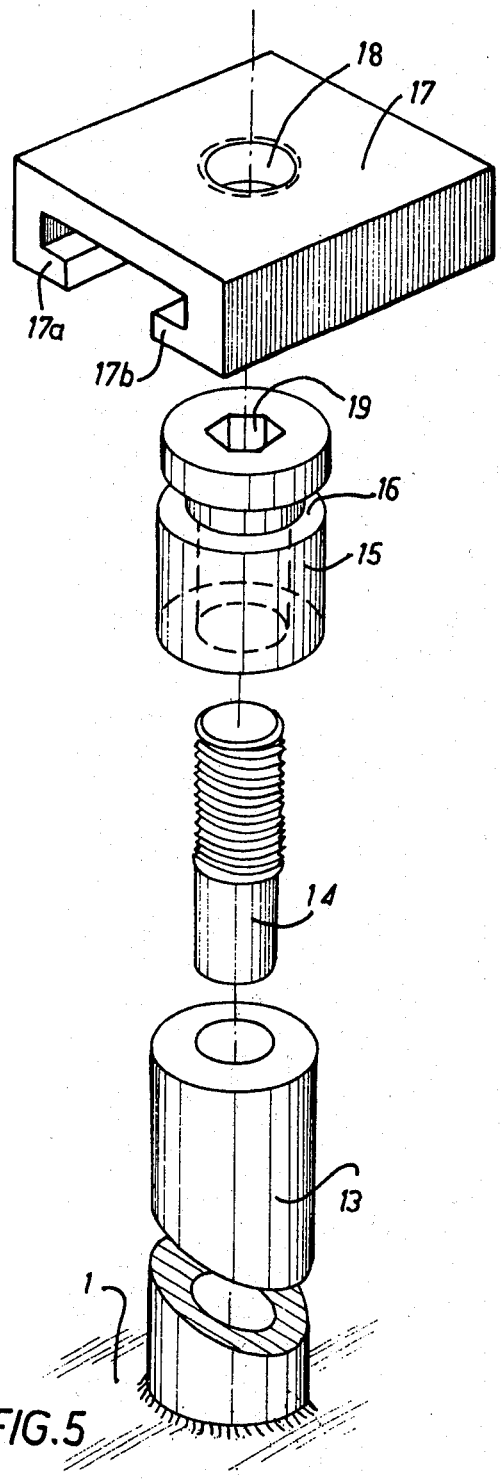
FIG. 5 is a view showing the various components of one of the fasteners holding the tank of FIG. 1 in place.

Referring now to the drawings, it will be seen that reference numeral 1 indicates the double hull or double compartment wall of the ship to which the primary and secondary barriers of the integrated tank according to the invention are to be applied. The secondary insulating barrier which is applied directly against the double hull 1, is made of boxes 2 made of laminated material, said boxes having the shape of a rectangular parallelopiped, and all having identical dimensions.

Inside each of the boxes 2 are transverse partitions perpendicular to the hull 1 and perpendicular to the plane of FIG. 1. These transverse partitions are not shown on the drawing in order to simplify it. The boxes 2 are filled with a heat insulating material such as Perilite, for example. Against the secondary insulating barrier constituted by the boxes 2 is located a secondary fluid-tight barrier consisting of metallic strips 3 having aligned edges, the strips being welded edge to edge. The primary fluid-tight barrier consists of insulating boxes 4 having a construction generally analogous to that of the boxes 2. This primary insulating barrier is covered by a primary fluid-tight barrier consisting of metallic strips 5 identical to the strips 3. The strips 3 and 5 are made of sheet Invar having a low coefficient of heat expansion. The basic principle of this embodiment is the one which is described in detail in French Pat. No. 1,438,330 corresponding to U.S. Pat. Nos. 3,399,800 and 3,403,651.

Figure 6:
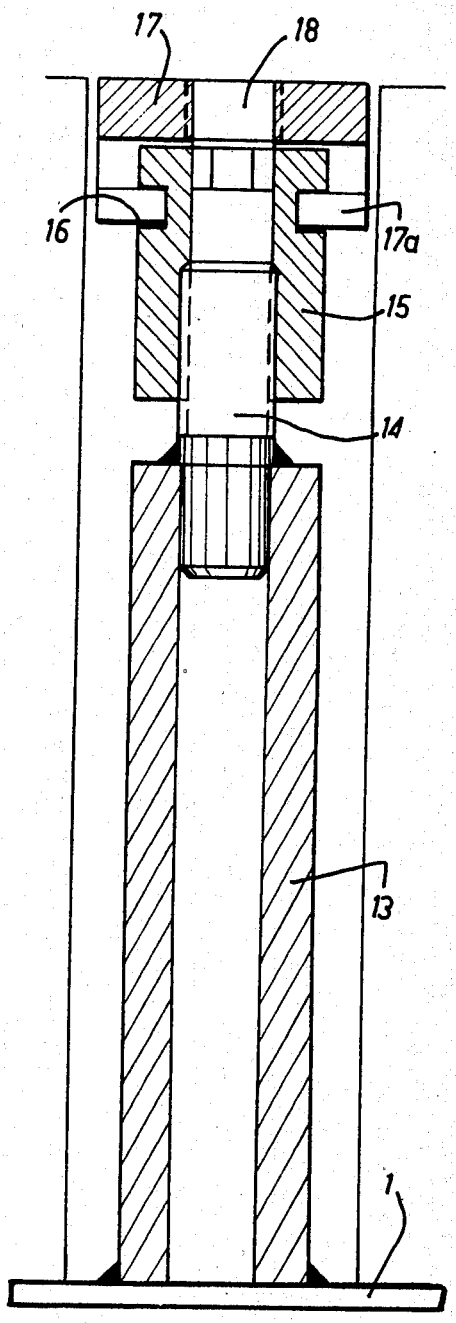
FIG. 6 shows the fastener of FIG. 5 in axial section, all its components assembled together.

Each box 2 comprises along its short sides 2*a*, on the edge of the short side which bears against the hull 1, a tenon made from two parts separated by a space 7, the two halves of the tenon being fastened to the major face of the box 2 which bears against the double hull. Along its longer sides, each box 2 has a groove 8 which receives a strip 9 which is bent into a channel shape and constitutes one of the components of a sliding joint. This strip 9 is adapted to cooperate with an intermediate channel-shaped strip which is thus aligned with the planes separating the two adjacent boxes 2 and the flanged edges 3*a* of the strips 3 are welded on opposite sides of this intermediate strip according to a tehnique which is illustrated in detail in FIG. 6 of French Pat. No. 1,438,330. The boxes 2 are positioned in parallel rows perpendicular to the plane of FIG. 1 and successive rows of boxes are located one above the other or beside the other depending upon whether the wall in question is vertical or horizontal. In order to hold the boxes 2 against the double hull 1, studs 10 are welded perpendicularly to the double hull 1, each stud cooperating with a square plate 11 which bears simultaneously against the edges of four tenons 6 belonging to four adjacent boxes 2. The boxes 2 are thus held at their four corners against the double hull 1 of the ship.

Figure 7:
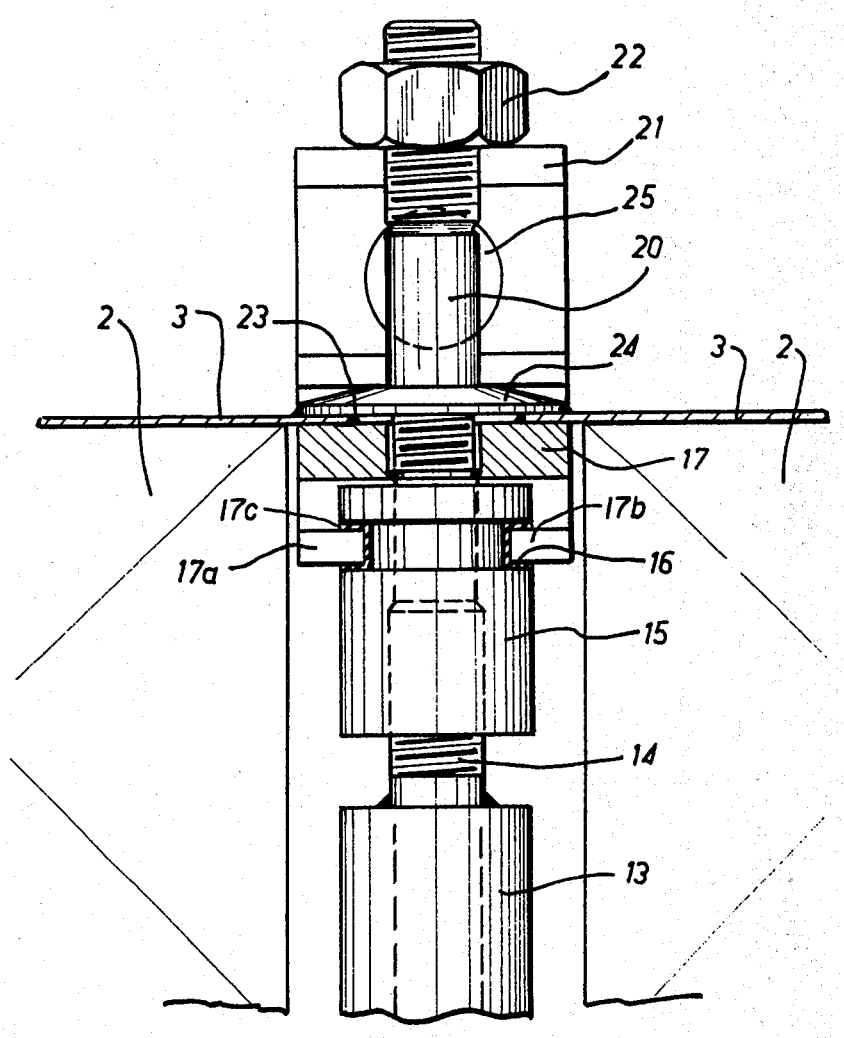
FIG. 7 shows the upper part of the fastener of FIG. 6 associated with a flanged stud which passes through the secondary fluid-tight barrier.
Figure 8:
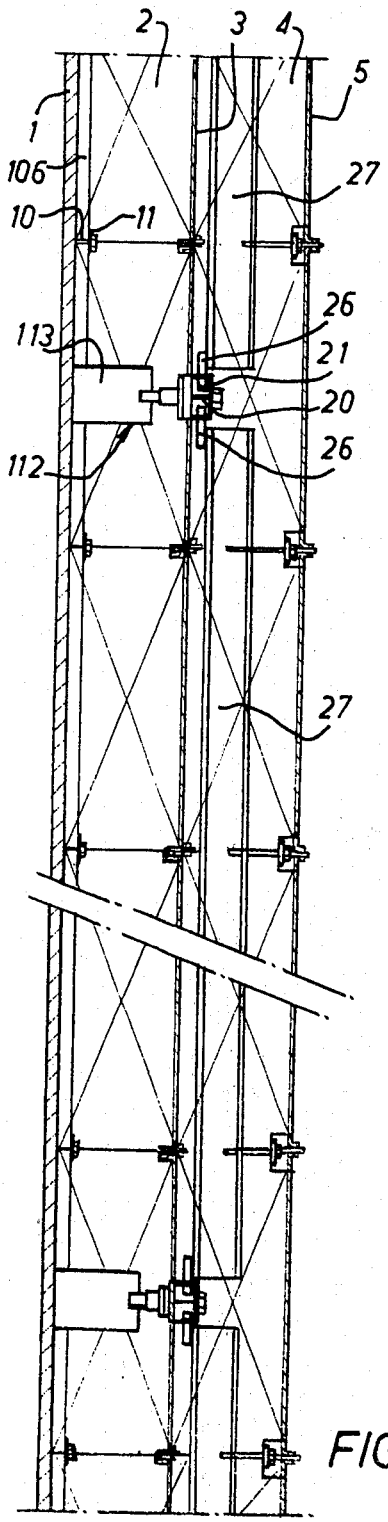
FIG. 8 is a sectional view analogous to the sectional view of FIG. 1 showing a tank utilizing a fastener according to the second embodiment of the invention.
Figure 9:
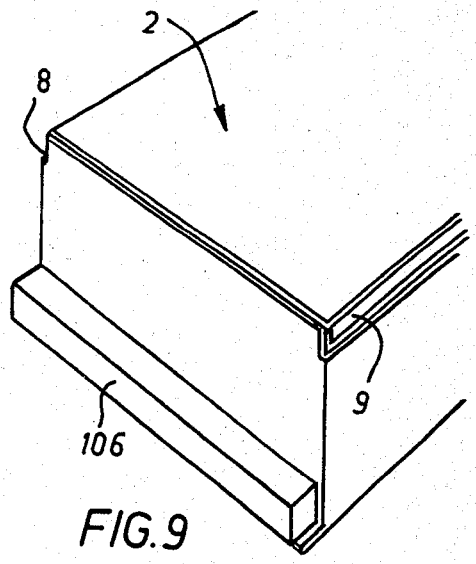
FIG. 9 is a perspective view showing the lateral edge of a secondary box of the tank of FIG. 8.
Figure 10:
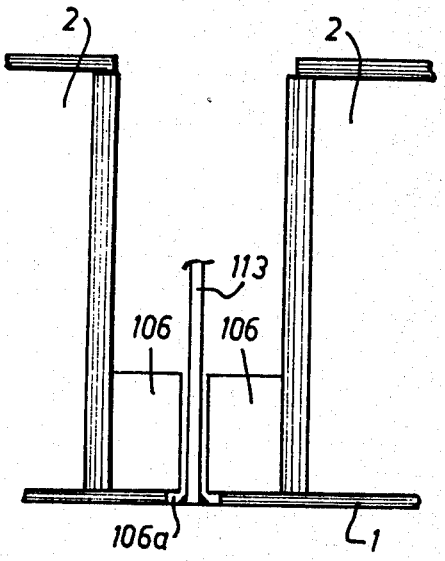
FIG. 10 is a partial sectional view perpendicular to the hull of a ship, said section showing the base of the fastener of FIG. 8.
Figure 11:
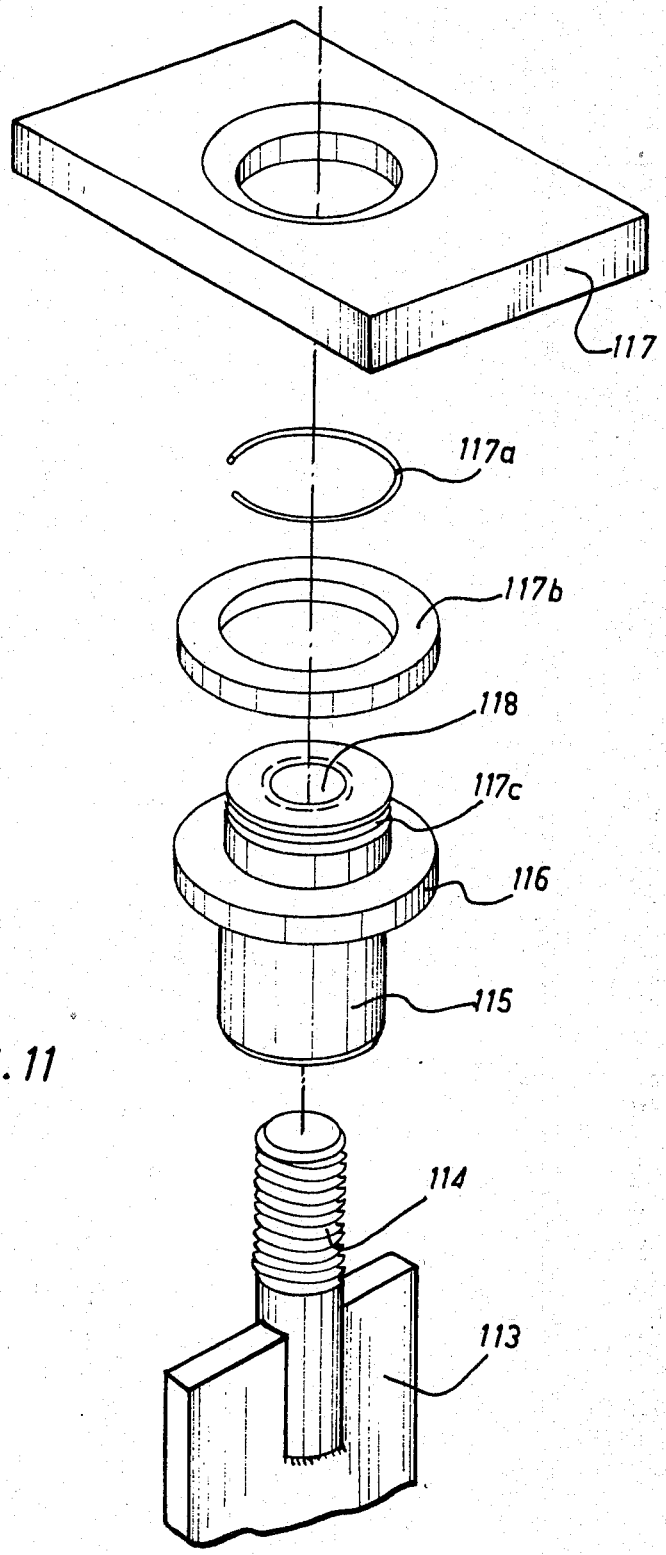
FIG. 11 is an exploded perspective view showing the different components of the fastener of FIG. 8.
Figure 12:
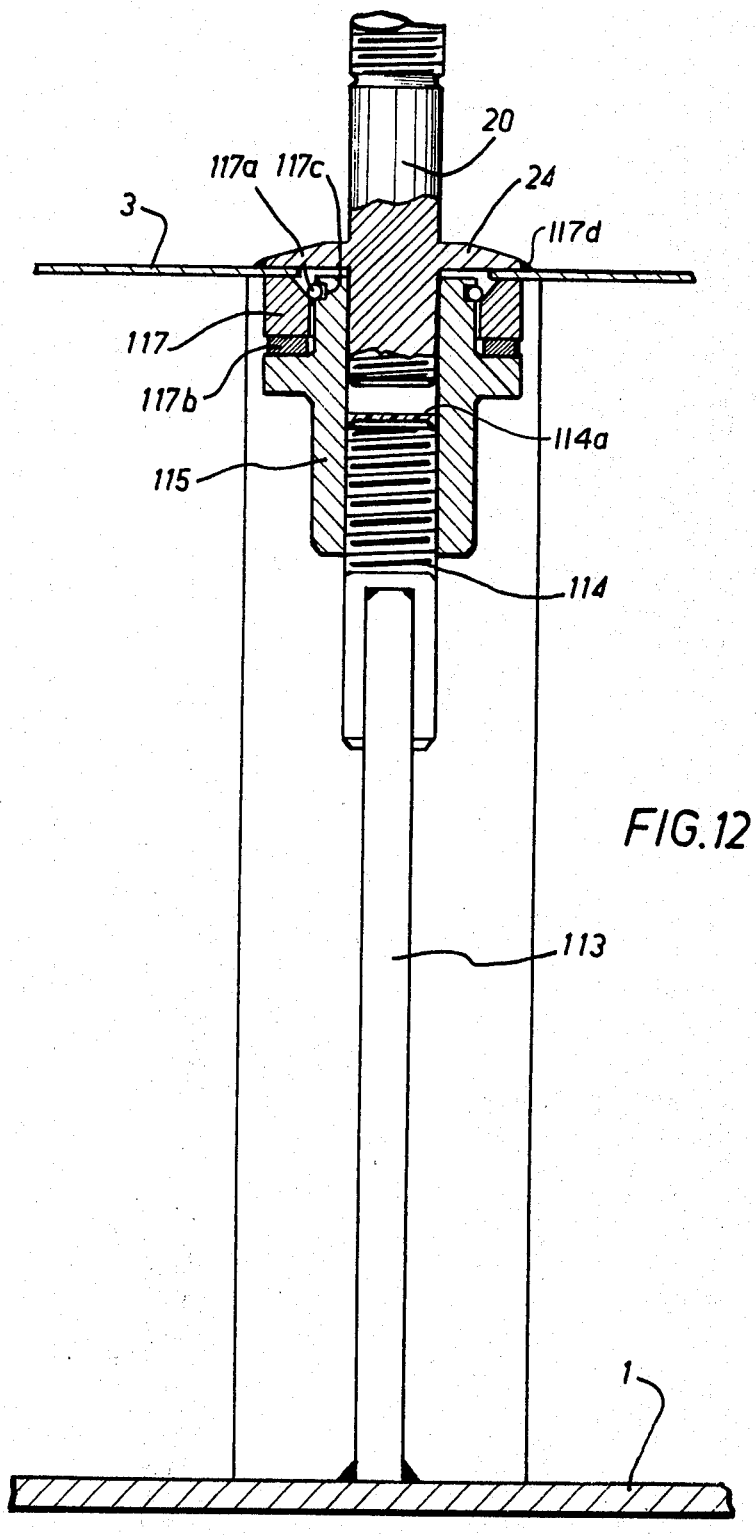
FIG. 12 is an axial sectional view taken through the fastener of FIG. 11 showing it mounted in position between two boxes of the secondary insulating barrier.
Figure 13:
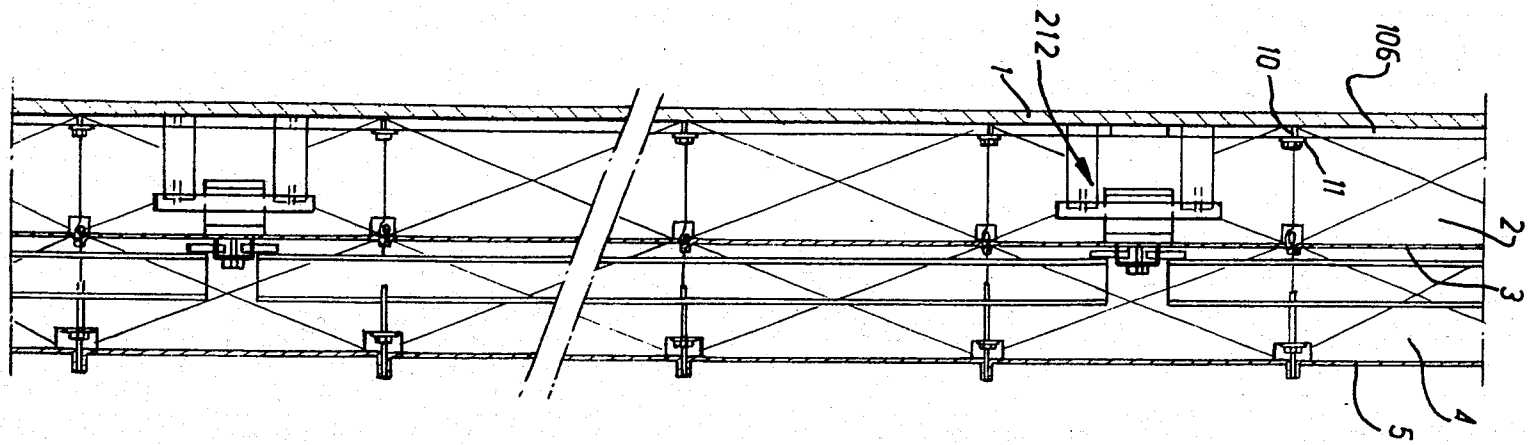
FIG. 13 is a sectional view similar to FIG. 1 showing a tank utilizing a fastener according to the third embodiment of the invention.
Figure 15:
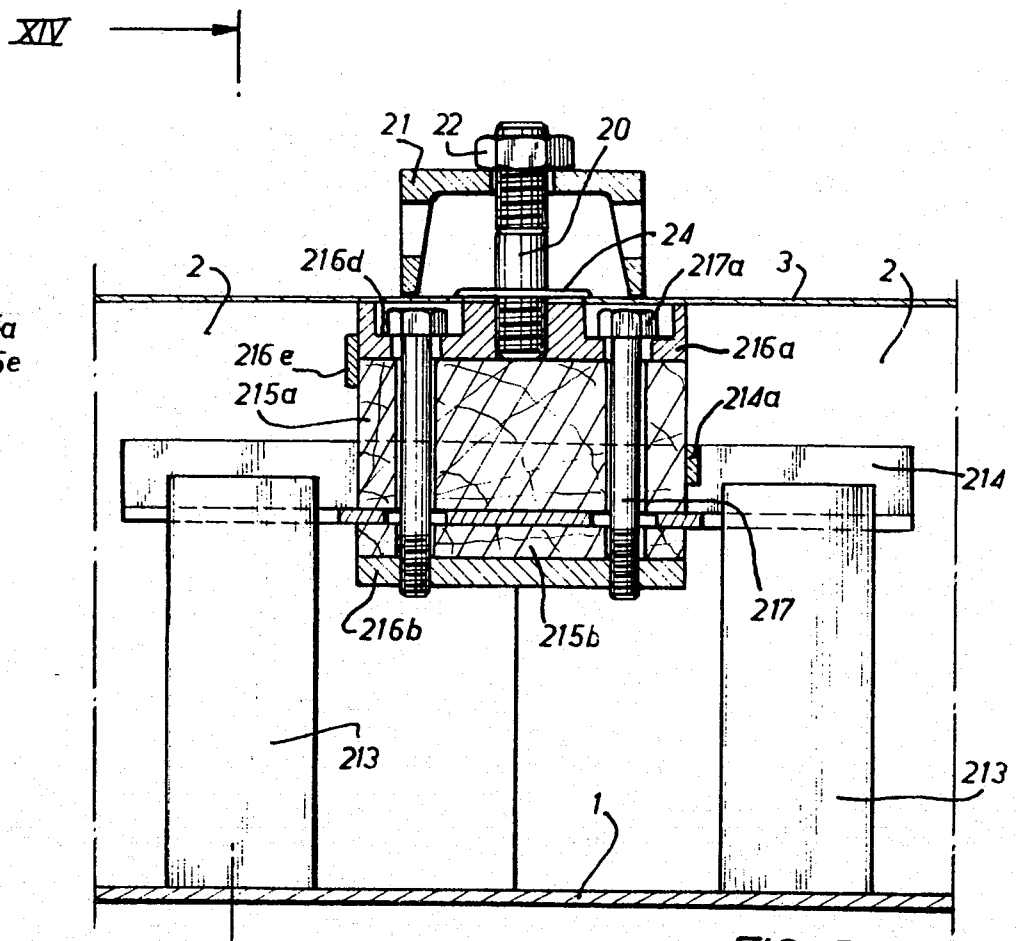
FIG. 15 is a sectional view taken along the line XV—XV of FIG. 14.
Figure 14:
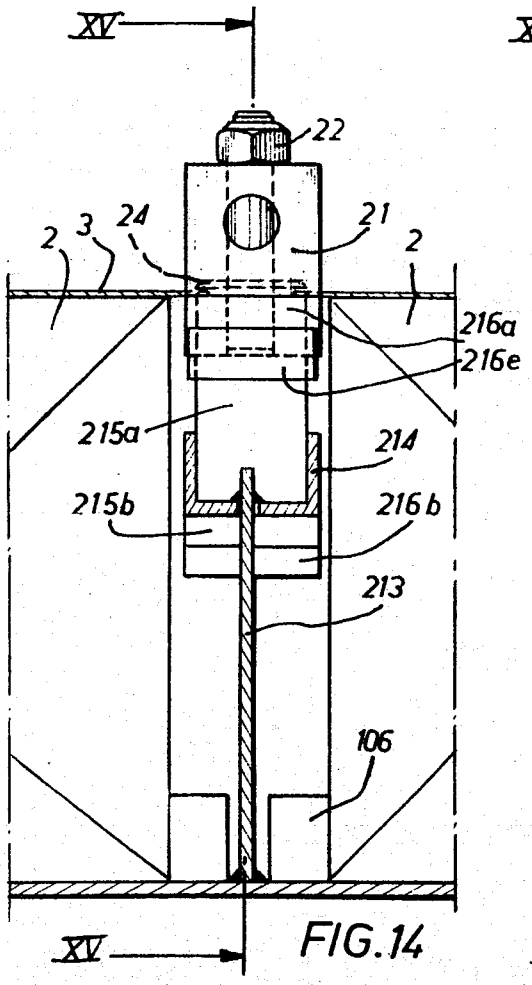
FIG. 14 is a sectional view through the fastener according to the third embodiment of the invention taken along the line XIV—XIV of FIG. 15, this section being taken perpendicular to the channel member of the fastener in alignment with the median line of one of the flexible and elastic plates.
Figure 16:
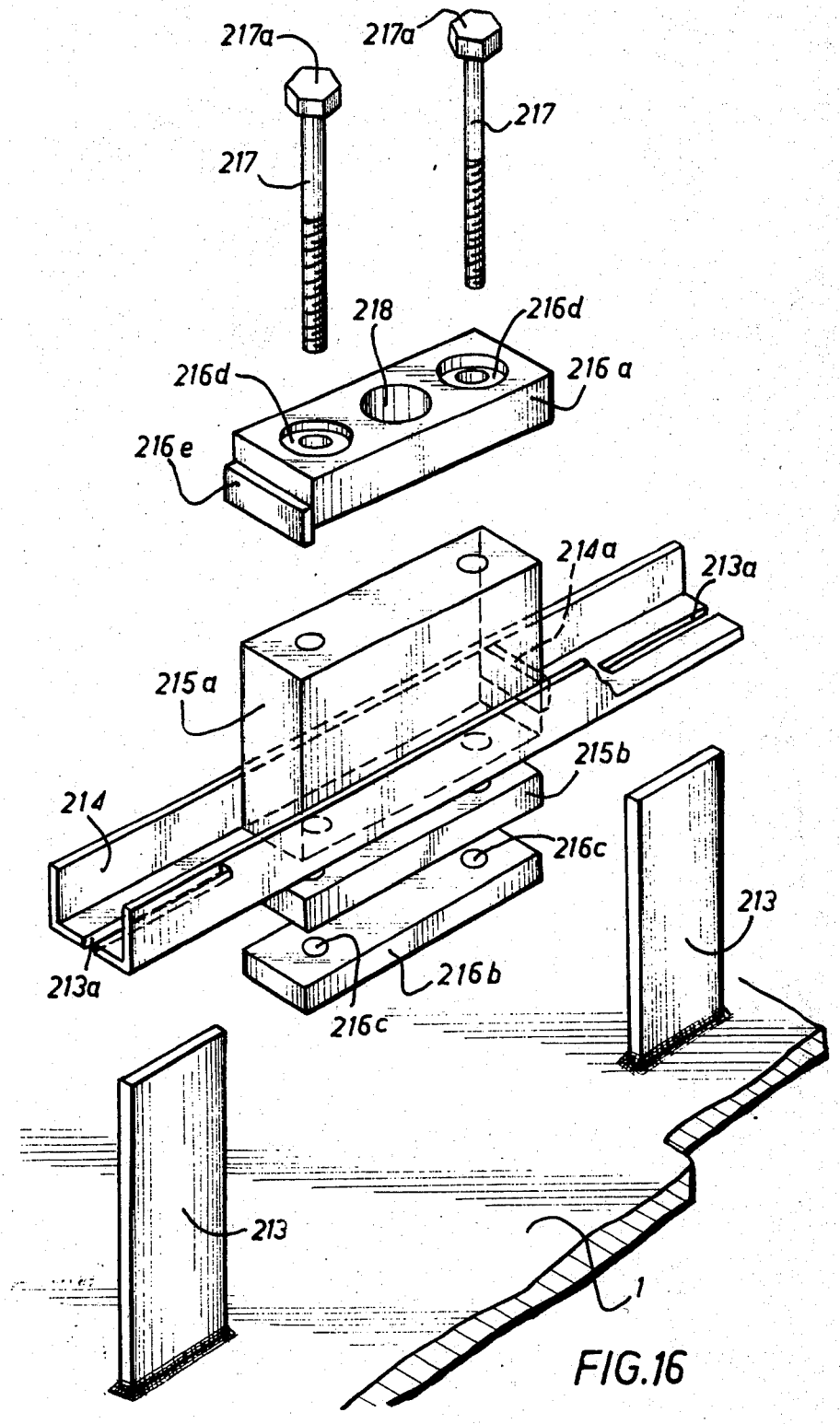
FIG. 16 is an exploded perspective view showing the different components of the fastener of FIGS. 14 and 15.

Between two successive boxes 2 of a given row of boxes perpendicular to the plane of FIG. 1 is a free space, the width of which is slightly greater than twice the width of the tenon parts 6. This provides, parallel to the plane of FIG. 1, passageways passing through the assembly of parallel rows of boxes 2. These passageways make it possible, inter alia, to provide for the free circulation of gas. In this space separating two successive boxes of a single row, there is located, in the case of certain rows only, a fastener indicated as a whole, by reference numeral 12. The fastener 12 consists of a tubular member 13 the base of which is welded to the double hull 1 of the ship and the other end of which is fixed to a threaded stud 14 onto which is screwed a head 15 comprising in its outer wall peripheral groove 16. On the head 15 is mounted a channel member having inwardly bent edges 17, the inwardly bent edges 17*a* and 17*b* of the channel member 17 being seated in the groove 16 and permitting translation of the channel member 17 relative to the head 15. A heat insulating washer 17*c* may be provided between the sides of the groove 16 and the channel member. The bottom of the channel member 17 is provided with a threaded hole 18 and when the channel member 17 is mounted on the head 15 the hole 18 permits access to a hexagonal seat 19 in the end of the head 15 communicating with the threaded end of the stud 14. The fastener is located in the space 7 between the two tenon parts 6 which separate two adjacent boxes 2 of the same row of boxes perpendicular to the plane of FIG. 1. The fastener 12 lies in the longitudinal median plane of the corresponding row of boxes 2. A flanged stud 20 is screwed into the threaded hole 18 in the channel member 17 which carries a channel member 21 (FIG. 7). The channel member 21 is held on the stud 20 by a nut 22. The strips 3 of the secondary fluid-tight barrier are pierced in alignment with the fasteners 12 so as to permit passage of the part of the stud 20 which is screwed into the threaded hole 18 in the channel member 17.

When the boxes 2 forming the secondary insulating barrier have been placed in position, the location of the head 15 is adjusted by means of a tool cooperating with the hexagonal seat 18 to bring the channel member 17 which is mounted on the head 15 to the theoretically proper position. The tool passes through the hole 18 and is adapted to screw or unscrew the head 15 on the threaded stud 14. When the proper position has been reached, this is maintained by placing a drop of solder on the inner thread of the head 15 with the soldering iron then passing through the hole 18 and the hexagonal seat 19 to reach the threaded zone of the end of the stud 14. Another method of locking the head 15 in position on the stud 14 consists in coating the thread of the stud 14 with a polymerizable resin before putting the head 15 in place. The polymerization of the resin is sufficiently slow so that there is time to adjust the position of the head 15 before the resin polymerizes. Another method consists in pouring, after adjustment of the head 15, through the threaded hole 18 and the hexagonal seat 19, a polymerizable resin which ends up on the end threads of the threaded stud 14. When the position of the head 15 is thus adjusted, the strip 3 is then located in alignment with corresponding row of boxes 2. The width of the strips 3 is equal to the height of the boxes 2, the flanged edges of the strips 3 extending along the larger sides of the boxes 2. As seen on FIG. 1, these longer sides are perpendicular to the plane of the figure.

The strips 3 have orifices in line with each of the threaded holes 18, said orifices having a diameter greater than the diameter of the threaded holels, and the channel members 17 are fixed in position inside the space separating two adjacent boxes 2 by means of a drop of solder or spot weld 23 on the edge of said orifices in the strips 3. The flanged stud 20 is then screwed into the threaded hole 18 until the flange 24 rests against the strip 20 and the edge of the flange 24 is then welded to the strip so as to form a fluid-tight connection.

The channel member 21, the side of which bears on the strip 3, is mounted on each stud 20 and the channel member 21 is locked in place by the nut 22 which cooperates with the part of the stud 20 remote from the part which is screwed into the channel member 17. The channel member 21 has in each side an orifice 5 pierced by a projection 26 fixed to the metallic channel members 27 positioned parallel to the plane of FIG. 1 perpendicularly to the median line of the rows of boxes 2 on the side of the strips 3 remote from the boxes 2. The fasteners 12 are distributed over the hull 1 along lines defined by the longitudinal median planes of certain rows of boxes 2 and, along each line, they are spaced by a constant distance equal to the length of a box 2 increased by the width of the space separating two successive boxes 2 in a single row. Two adjacent lines of fasteners are parallel and spaced by a distance equal to a multiple of the height of the boxes 2, for example by a distance equal to five boxes 2. For the walls of the tank which are not perpendicular to the longitudinal axis of the ship, the lines of fasteners are parallel to this longitudinal axis and for the walls which are perpendicular to said axis the lines are perpendicular to the longitudinal median plane of the ship. Channel members 27 are held at each end by a projection 26 cooperating with a channel member 21 and it is obvious that the length of each channel member 27 is dependent upon the spacing between two successive lines of fasteners 12.

The boxes 4 of the primary insulating barrier are positioned exactly opposite the boxes 2 of the secondary insulating barrier. Each box 4 comprises along the longitudinal edges of its longer sides **4*b*, grooves 28*a*, 28*b*, positioned near the strips 3 and 5 respectively. The groove 28*a* receives the bent-in edges of the strips 3 which grip the intermediate welding strip, retained by the sliding joint 9. Groove 28*b* comprises a strip 9 formed in a U-shape identical to the one received in the groove 8 of the boxes 2. On each of the short sides of the boxes 4, along the edge nearest the strips 5, a tenon 29 which comprises at each end a notch 30. When all the boxes 4 are exactly positioned in alignment with the boxes 2, the notches 30 belonging to four adjacent boxes are side by side and a square plate 31 is located in these four notches 30 and held there by a threaded stud 32 which is screwed into a corresponding threaded orifice in one side of channel member 27, thereby fastening the boxes 4 to the channel member 27. The bent strip 9 located in the groove 28*b* constitutes one of the members of the sliding joint, the other member of which is an intermediate U-shaped strip 33.**

The flanges of the two adjacent strips 5 are welded to opposite sides of the strip 33, this arrangement being described in French Pat. No. 3,438,330 corresponding to U.S. Pat. Nos. 3,399,800 and 3,403,651, and illustrated on FIG. 6 of that patent.

It will be seen that the embodiment which has just been described makes it possible to use boxes 2 and 4 which are all of the same dimensions. Boxes 2 are held against the hull 1 by the studs 10. The strips 3 forming the secondary barrier are held against the boxes 2 by sliding strips 9 located in the grooves 8. Boxes 4 are fastened by the studs 32 to the bars 27 which are attached by the fasteners 12 to the hull, and the strips 5 are held on the boxes 4 by the sliding joints 9 in the grooves **28*b*. It will thus be seen that this arrangement makes it possible be benefit from the advantages provided in the arrangement described in French Pat. No. 1,438,330 corresponding to U.S. Pat. Nos. 3,399,800 and 3,403,651, but also permits all the boxes 2** of the secondary insulating barrier to have identical dimensions, which was not the case in the prior arrangement, in which it was necessary to leave space for the planks to which the metallic bars associated with the primary insulating barrier were attached.

Furthermore, it is no longer necessary to form a groove in the surface of the boxes of the secondary insulating barrier to receive the sliding U-shaped strips intended to hold the metallic strips of the secondary sealing barrier because the welds of the strips 3 are in alignment with the joint between the boxes 2. This represents a considerable economic advantage and avoids weakening the boxes 2. Finally, when the hull of the ship deforms in response to the waves, the deformation of the hull is not directly transmitted to the secondary sealing barrier because of the possibility of translational movement between the channel member 17 and the head 15 of the fastener 12. This advantage was provided by other means in the prior art. It should be noted that the heat conducting path existing between the channel member 17 and the head 15 consists of the zone of contact between the bent back sides **17*a*, 17*b* and the groove 16.** This path may be decreased by interposing a washer of heat insulating material in this zoneof contact.

FIGS. 8 to 12 illustrate a second embodiment of the invention. The general arrangement of the various components of the integrated tank is the same as in the first embodiment and will not be repeated in detail. Reference numeral 1 still indicates the double hull of the vessel, 2 and 4 the boxes of the secondary and primary insulating barriers respectively, 3 and 5 the strips forming the secondary and primary insulating barriers respectively. The boxes 2 are attached to the hull by studs 10 bearing through plates 11 on tenons 106 positioned along the hull or sides of the boxes 2 as has been described in the first embodiment. Tenons 106 are identical to the tenons 6 except that they are made in a single piece instead of being divided into two separate parts by a recess. On the longitudinal edges adjacent the strips 3 the boxes 2 have grooves 8 and there is a U-shaped strip 9 as in the preceding embodiment adapted to constitute one member of a sliding joint for the intermediate strip which is welded to the two adjacent flanges of two adjacent strips 3. The arrangement of the boxes 2 of the secondary barrier is the same as described in connection with the first embodiment and the fasteners 112 are positioned in the free spaces between two boxes 2 of a single row perpendicular to the plane of FIG. 8. All the spaces pertaining to the different rows of boxes 2 placed side by side constitute passages for the free circulation of gas. As before, the fasteners 112 are positioned along lines located on the hull in the longitudinal median plane of a row of boxes 2 and two successive lines of fasteners are spaced by a distance which is a multiple of the height of the boxes 2.

The fastener 112 consists of a metallic plate 113 which is, for example, 8 mm in thickness and a rectangular shape so that it is about 150 mm in height by 100 mm wide. These dimensions are given for boxes 50 cm wide, 95 cm long and 20 cm thick. As the upper part of the plate 113 is mounted a threaded stud 114 which receives a threaded head 115 which comprises a collar 116. A rectangular plate 117 is mounted on the head 115 and held thereon by a circular clip 117*a*. The plate 117 is held against the collar 116 with an insulating washer 117*b* therebetween. The circular clip 117*a* is seated in a groove 117*c* formed in the upper part of the head 115. The head 115 comprises a threaded seat 118, into the lower part of which is screwed the threaded stud 114, the upper part of which receives a flanged stud 20 identical to the one described in the first embodiment of the invention.

At the moment of mounting, the boxes 2 of the secondary insulating barrier are placed in position and the head 115 is adjusted so that it is at a suitable distance from the hull 1. The position of the head 115 is then fixed with respect to the thread of the stud 114 as has been previously described in the first embodiment in connection with the attachment of the head 15 to the stud 14, e.g. by a layer of polymerizable resin 114*a* which seeps down between the threads before hardening.

A plate 117 insulated by the washer 117*b* and held in place by the circular clip 117*a* placed in position, followed by the strip 3 which is aligned with the fastener. This strip comprises an orifice in alignment with each fastener 112 and with the head 115. The plate 117 is fixed in position with respect to the head 115 by means of a drop of solder 117*d* applied near the circular clip 117*a* to prevent the plate 117 from twisting with respect to the space separating the two insulating boxes 2.

The stud 20 is then screwed into the orifice 18 in the head 115 until the flange 24 of the stud 20 bears against the strips 3, and the flange 24 is then welded to the strips 3 around its entire periphery so as to insure a fluid-tight seal, A channel member 21 is mounted on the stud 20 as in the case of the preceding embodiment. This supports by means of projections 26 metallic bars 27 identical to those of the first embodiment. The assembly of the primary insulating barrier and the primary sealing barrier than takes place as has been previously described in connection with the first embodiment.

It should first be noted that the advantage of the fastener according to the second embodiment is to avoid having to divide the lateral tenons mounted on the boxes 2 of the second insulating barrier into two parts. However, since the plate 113 is welded too the hull 1 there are, in general, a certain number of rough places at the base of the plate and some space must be left between the tenons so that these rough places do not interfere with the positioning of the boxes 2. If the tenons are too close it is necessary to leave a space 106*a* (FIG. 10) between the edges of the faces of the box 2 which carry the tenons 106 so that the edges are sufficiently spaced from each other even if the tenons 106 are not. It follows that the tenons 106 project beyond the edges of the larger sides of the boxes 2 which carry them as is clearly seen on FIG. 10. Another advantage of the second embodiment which has just been described results from the fact that in case of deformation of the ship in response to wave action, flexing of the plates 113 is insured while avoiding any deterioration of the secondary sealing barrier in the zones of attachment of this barrier to the fasteners. This deformation by flexing is permitted in displacement of the welding zone substantially parallel to the line of fasteners 112 so that in the case of the translating means of the first embodiment there may be some difficulty in sliding the channel member 17 having bent-in sides with respect to the head 15.

In the two embodiments which have been described one may advantageously, in the free space between the boxes 2 in the places in which no fasteners 12 or 112 are found, provide a filling of an insulating material such as rock wool, this filling being held in place by a cover positioned between two adjacent boxes of a given row of boxes and attached to each box by hooks which may be deformed to permit the deformation of the secondary insulating barrier when the hull of the ship deforms in response to the affects of the waves. This arrangement makes it possible to provide a load supporting member constituted by the cover in alignment with the free spaces filled with rock wool.

On FIGS. 13–16 a third embodiment of the invention is illustrated. The general arrangement of the different components of the integrated tank is the same as for the first and second embodiments and will not be repeated in detail. Reference numeral 1 still indicates the double hull of a ship, 2 and 4 indicate respectively the boxes of the secondary and primary insulating barriers, while 3 and 5 indicate the strips of the secondary and primary sealing barriers respectively. The boxes 2 are attached to the hull by means of studs 10 bearing on plates 11 on tenons 106 positioned along the short sides of the boxes 2 as described in the second embodiment. On their longitudinal edges adjacent the strips 3, the boxes 2 have grooves 8 and there is provided as in the second embodiment a U-shaped strip 9 adapted to slidably receive the intermediate strip to which the two adjacent flanged edges of the two strips 3 are welded. The boxes 2 used for this third embodiment are identical to those of the second embodiment and are consequently as represented on FIGS. 9 and 10. The arrangement of the boxes 2 of the secondary barrier is the same as that described for the second embodiment and the fasteners 212 are positioned in the free spaces between two boxes of a given row perpendicular to the plane of FIG. 13.

All the spaces in the different row of boxes placed side by side constitute passageways for the free circulation of gas. As in the previous cases, the fasteners 212 are placed along lines positioned on the hull of the ship in the longitudinal median plane of a row of boxes 2, two successive lines of fasteners being spaced by a distance which is a multiple of the height of the boxes 2.

A fastener 212 consists of two metallic plates 213 which are for example 8 mm thick and have a rectangular shape being 150 mm long by 50 mm wide. These dimensions are given for boxes having a width of 50 cm, a length 95 cm and a thickness of 20 cm. The upper parts of the plates 213 are positioned inside slots 213*a* in the bottom of a channel member 214.

In the central part of the channel member 214 its bottom is gripped between two strips of wood 215*a*, 215*b*, which are carried by metallic gripping plates 216*a*, 216*b*, the assembly being held together by two bolts 217 which pass through the gripping plates 216*a*, 216*b*, the two wooden strips 215*a*, 215*b*, and the bottom of the channel member 214. The bolts 217 have threaded ends which cooperate with a corresponding thread in the holes 216*c* of the gripping plate 216*b*. The holes in the channel member in which the bolts 217 are positioned have a diameter greater than the diameter of the bolts so as to permit relative displacement of the gripping plates 216*a* with respect to the channel member 214. The channel member 214 is attached to the two plates 213 by welding when the position of the channel member 214 has been adjusted to the desired distance from the double hull 1 of the ship. This adjustment is carried out after the strips 215*a*, 215*b* have been previously positioned on the channel member, together with the gripping plates 216*a*, 216*b* and the bolts 217. Recesses 216*d* are formed in the gripping plate 216*a* to receive the heads 217*a* of the bolts 217. Locating strips 214*a* and 216*e* are respectively associated with the channel member 214 and the gripping plate 216*a* in order to properly position the strip 215*a*. The bolts 217 are tightened with a torque wrench so as to permit movement of the gripping plate 216*a* with respect to the channel member 214 in response to a sufficiently large force exerted on the gripping plate. The gripping plate 216*a* carries in a threaded hole 218 a flanged stud 20 identical to the one which has been described in the first and second embodiments of the invention. This stud 20 grips between its flange 24 and gripping plate 216*a* the metallic strips 3 of the secondary fluid-tight barrier. The stud 20 supports a yoke 21 by means of a nut 22 as has been described in the first and second embodiments of the invention. The flange 24 is welded to the strips 3 in order to insure the sealing of the secondary fluid-tight barrier and the insulating barriers and primary fluid-tight barrier are constructed as has been previously indicated in the two first embodiments of the invention.

It is obvious that the advantage of the attaching device according to this third embodiment is that it permits movement of the gripping plate 216*a* with respect to the channel member 214 in response to flexing of the ship due to the effects of the waves. This avoids the risk of breaking the seal in alignment with the flange 24. Of course the plates 213 are flexible, like the plates 113 of the second embodiment, which leads to the same result as above indicated. Moreover, the adjustment in the height of the gripping plate 216*a* is made possible by reason of the fact that the channel member 214 can slide with respect to the two plates 213 before the channel member 214 is welded to the plates 213.

Finally, it should be noted that the existence of the two strips 215*a*, 215*b* makes it possible to substantially diminish the heat transfer path existing between the stud 20 and the plates 213, thus improving the thermal insulation of the assembly.

It will of course be appreciated that the embodiments which have been described herein have been given purely by way of illustration and example, and may be modified as to detail without thereby departing from the basic principles of the invention, as defined by the following claims.

What is claimed is:

1. In a ship having at least one fluid-tight heat insulated compartment built into the framework of the ship and defined within double walls, forming part of said framework, each compartment having, in succession a first sealing barrier in the inside of said compartment, a first insulating barrier, a second sealing barrier, and a second insulating barrier adjacent said wall, each insulating barrier comprising a plurality of parallel rows of boxes containing insulation, with spaces between the boxes of each row of at least said second insulating barrier, and each sealing barrier comprising a corresponding number of rows of flanged strips having their edges sealed together along lines registering with the intersections between successive rows of boxes, the improved fastening means for attaching said second sealing barrier to said wall which comprises an elongated member having one end fixed to said wall and projecting substantially perpendicularly therefrom, a first threaded member carried by said elongated member, a second threaded member sealed to said second sealing barrier and engaging said first threaded member, said second threaded member being capable of limited movement relative to said wall in a direction transverse to a perpendicular to said wall, said elongated members being located in parallel lines, each registering with the median plane of a row of boxes in said second insulating barrier and extending through said spaces between the boxes in that row.

2. Fastening means as claimed in claim 1 in which said first threaded members are adjustable along said elongated member with respect to their distance from the wall of the ship.

3. Fastening means as claimed in claim 1 in which said second threaded members which pass through the secondary sealing barrier are flanged studs, one end of each stud being fastened to the free end of said elongated member so that its flange may bear on the second sealing barrier.

4. Fastening means as claimed in claim 3 in which the other end of the flanged stud is threaded and cooperates with a channel member, the two sides of which are provided with orifices which receive projections carried by bars parallel to the primary insulating barrier.

5. Fastening means as claimed in claim 1 in which one end of said elongated member is welded to said wall, while its other end comprises a threaded portion on which a head constituting said first threaded member is mounted, said head comprising a peripheral groove which slidably cooperates with the inturned edges of a channel member in which said second threaded member is fixed.

6. Fastening means as claimed in claim 5 comprising a heat insulating heat washer positioned between the sides of the channel member and the sides of the groove formed in said head.

7. Fastening means as claimed in claim 5 in which the position of said head on the elongated member is fixed after the adjustment of the position of the head.

8. Fastening means as claimed in claim 5 in which the upper part of the head comprises rotatable adjusting means accessible through a threaded orifice which receives the flanged stud and is formed in the channel member having inwardly bent edges.

9. Fastening means as claimed in claim 1 in which said elongated member is a flexible elastic metallic plate attached along one of its edges to said wall and carrying on its opposite edge one end of a threaded stud which cooperates with a threaded head constituting said first threaded member, said head receiving at its other end the thread of a flanged stud constituting said second threaded member.

10. Fastening means as claimed in claim 9 in which each flanged stud is located in the head with its flange against one side of said second sealing barrier, while the other side of said sealing barrier rests against a plate bearing against said head through an insulating washer.

11. Fastening means as claimed in claim 10 in which said plate is held against said head by a circular clip.

12. Fastening means as claimed in claim 11 in which the said plate is fixed in position with respect to said head by a drop of solder.

13. Fastening means as claimed in claim 9 in which said head is fixed in position with respect to the threaded stud by means of polymerizable resin on said threads.

14. Fastening means as claimed in claim 5 in which each of the edges of each box of the secondary insulating barrier which do not come in contact with the adjacent box carry tenons comprising in their median zone a recess adapted to receive the elongated member of a fastener.

15. Fastening means as claimed in claim 9 in which the side of each box of the secondary insulating barrier which bears against said wall is slightly recessed with respect to tenons positioned on those of the edges of which box do not come in contact with the adjacent box.

16. Fastening means as claimed in claim 1 in which said elongated member comprises two parallel flexible and elastic metallic plates attached by one of their edges to said wall and near their opposite edge to a channel member, said channel member being fixed to two plates and having its bottom, in the zone between the two plates, positioned between two strips of wood by means of bolts bearing on gripping plates on opposite sides of the two strips, the gripping plate which is remote from said wall carrying the flanged stud constituting the second threaded member of each fastener.

17. Fastening means as claimed in claim 16 in which the channel member is a U-shaped beam welded to two metallic flexible plates, said plates passing through slots in the bottom of said U-shaped member.

* * * * *